United States Patent [19]

Jones

[11] 4,106,112

[45] Aug. 8, 1978

[54] HANDLING AND COOLING FOUNDRY SAND

[75] Inventor: Leonard Leslie Jones, Aldridge, England

[73] Assignee: Mechandex Engineering (Wolverhampton) Ltd., Wolverhampton, West Midlands, England

[21] Appl. No.: 795,281

[22] Filed: May 9, 1977

[30] Foreign Application Priority Data

May 14, 1976 [GB] United Kingdom ..... 198 95/76

[51] Int. Cl.[2] ..... B22C 5/16

[52] U.S. Cl. ..... 366/4; 198/580; 198/952; 366/7; 366/10; 366/27

[58] Field of Search ..... 259/148, 149, 153, 154, 259/161, 162, 164, 165, 169, 170; 198/580, 952

[56] References Cited

U.S. PATENT DOCUMENTS

| | | | |
|---|---|---|---|
| 2,552,930 | 5/1951 | Booth et al. | 198/580 X |
| 3,110,421 | 11/1963 | Matthias | 259/154 X |
| 3,111,304 | 11/1963 | Bridger et al. | 259/161 X |
| 3,182,969 | 5/1965 | Rupp | 259/154 X |

*Primary Examiner*—Philip R. Coe

*Attorney, Agent, or Firm*—Wender, Murase & White

[57] ABSTRACT

A process and an apparatus for cooling and handling sand in which hot used sand is delivered to a mixer and mixed with cooler sand. The mixed sand is discharged from the mixer for circulation on conveyor means for further cooling and the cooled sand is separated into a first fraction for discharge to successive milling and moulding stages and a second fraction for return to the mixer to effect sand mixing with the hot used sand. Water may be added to the mixed sand in the mixer to adjust the moisture content and to increase cooling.

8 Claims, 5 Drawing Figures

HANDLING AND COOLING FOUNDRY SAND

BACKGROUND OF THE INVENTION

This invention concerns improvements in or relating to a foundry process for cooling and handling foundry sand for use in green sand moulding.

It is the practice to recycle foundry sand after it has been shaken out from the castings. However difficulties arise in both handling and moulding hot sand. In particular, the handling of hot sand creates dust and other pollutants and hot sand has poor flowability, and the moulding characteristics such as strength and permeability are unsatisfactory. For these reasons, and others not mentioned, the foundry sand has to be cooled before it can be recycled, and such cooling requires either special equipment or extensive storage.

It has already been proposed to recycle foundry sand by a process in which hot sand is broken up and mixed with a sufficiently large quantity of fresh or cooled sand so that the resultant mixture has a temperature of below 120° F. Such process is described in the Complete Specification of U.K. Pat. No. 1,266,606 and in use substantial advantages are obtained to overcome the difficulties just mentioned.

In the process of mixing hot and fresh or cooled sand there is a fundamental requirement that the tonnage of foundry sand in the cycle be far greater than the amount of sand required for moulding. For example, if the hot used sand has to be mixed in the rate of 1:3 with fresh or cooled sand, and the casting rate is such as to use 50 ton/hour of moulding sand, the sand in the cycle must be at least 150 ton/hour.

In order to employ such process in and existing plant, the sand handling and treatment plant cannot be simply modified to increase its capacity by three times. Accordingly, the change to such process may incur substantial capital investment and foundry shutdown so that there is a financial deterrent.

SUMMARY OF THE INVENTION

It is an object of this invention to provide a method whereby the mixing process can be employed to gain the advantages thereof, but the disadvantages of disruption and extensive plant modification for the increased carrying capacity are avoided.

According to this invention we provide a process for cooling and handling sand wherein hot used sand is supplied to a mixer for mixing with cool sand, the mixed cooler sand is discharged for circulation on conveyor means for further cooling to provide a first cool sand fraction for discharge to successive milling and moulding stages, and a second cool sand fraction for said mixing with hot used sand.

With the invented process, the rate of supply of not used sand is that related to the casting rate, and the rate of discharge of the first cool sand fraction from a conveyor means will be substantially the same. Accordingly, only a relatively low capacity plant is required to handle such supply and discharge and subsequent milling and the capacity is no more than that for the traditional process. The high capacity requirement is limted to the conveyor means and the mixer which are required to handle the total tonnage of foundry sand in the process. However, the provision of such a high capacity plant is either a simple supplement to an existing plant, or cheaper than providing a high capacity plant throughout the foundry.

According to another aspect of this invented process, as the hot sand is mixed with the cool sand, the moisture content may be adjusted to increase cooling. Additionally, the conveyor means may include means for turning the mixed sand to promote faster cooling.

As a further consequence of this invented process, the proportions of the cool sand and hot used sand can be adjusted and controlled in the mixer so as to ensure that the temperature of the discharged fraction is low enough. As the discharged fraction is small and also will be cooled on advancement to and during milling, and before moulding, the discharge temperature may be slightly higher than that required in the prior process where all the mixed sand is circulated for milling. Additionally, sand correction during milling is only required for that small fraction.

From another aspect of this invention we provide apparatus for cooling and handling sand, the apparatus comprising a supply conveyor arranged to receive hot used sand and to supply said hot used sand to a mixer, cooling conveyor means for continuously circulating and cooling sand discharged from the mixer, a feed for supplying a first fraction of the cooled sand to a discharge from the conveyor means and a second fraction of the cooled sand from the conveyor means to the mixer.

To further understand this invention, reference will now be made to the accompanying schematic drawings.

BRIEF DESCRIPTION OF A PREFERRED EMBODIMENT

With reference to the drawings, hot used sand is advanced on a conveyor belt 20 which is inclined upwards to discharge at a mill 21. The hot used sand may be stored in hoppers 22 for discharge onto the belt 20.

Figure 1:
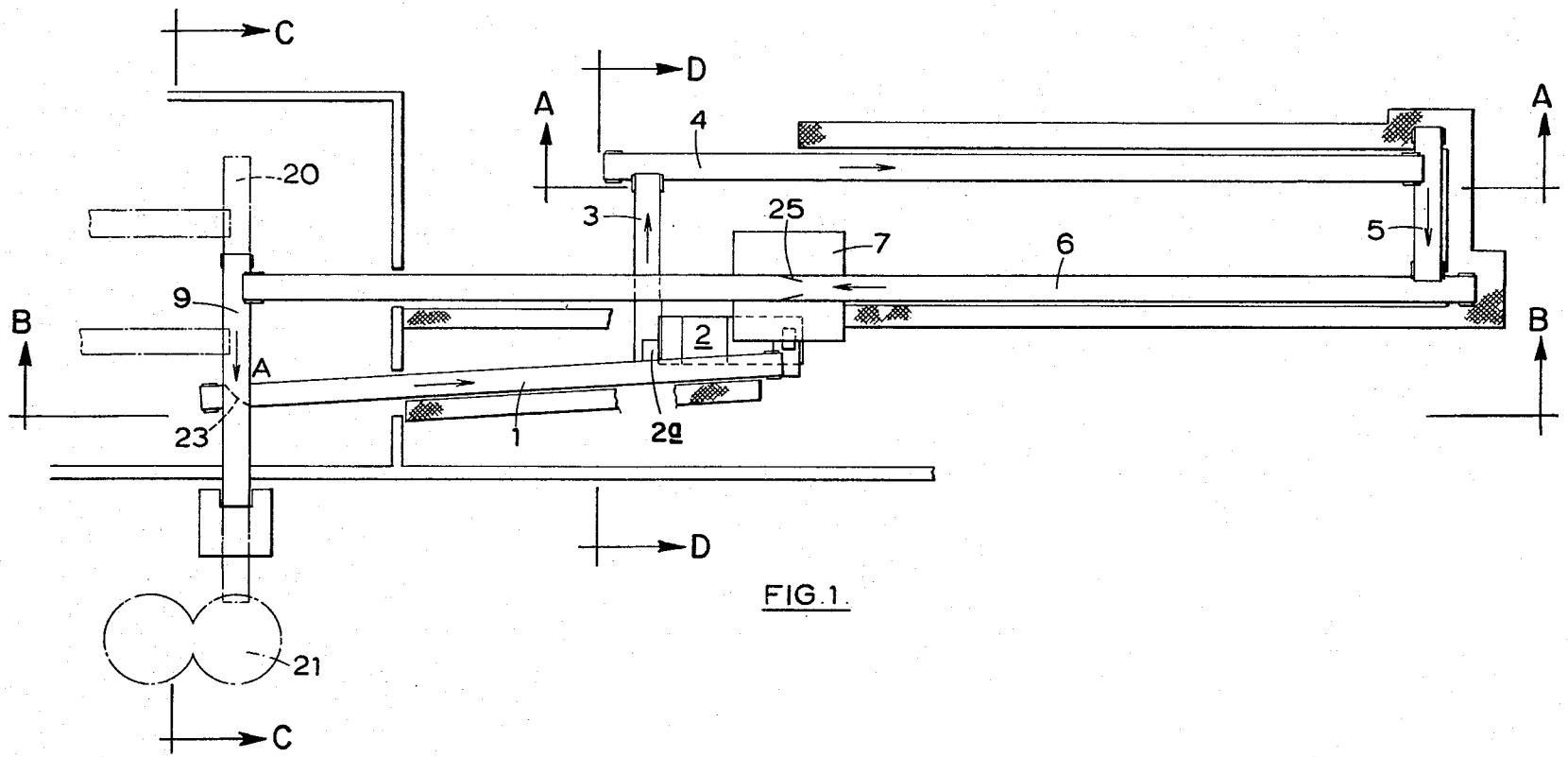
FIG. 1 is a plan view of an exemplary embodiment of the apparatus.
Figure 2:
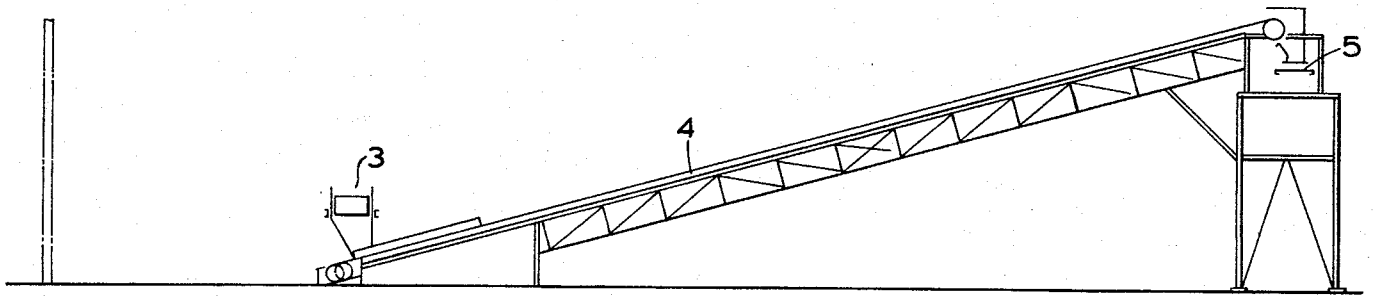
FIGS. 2, 3, 4 and 5 are respectively views on sections AA, BB, CC, and DD of FIG. 1.
Figure 3:
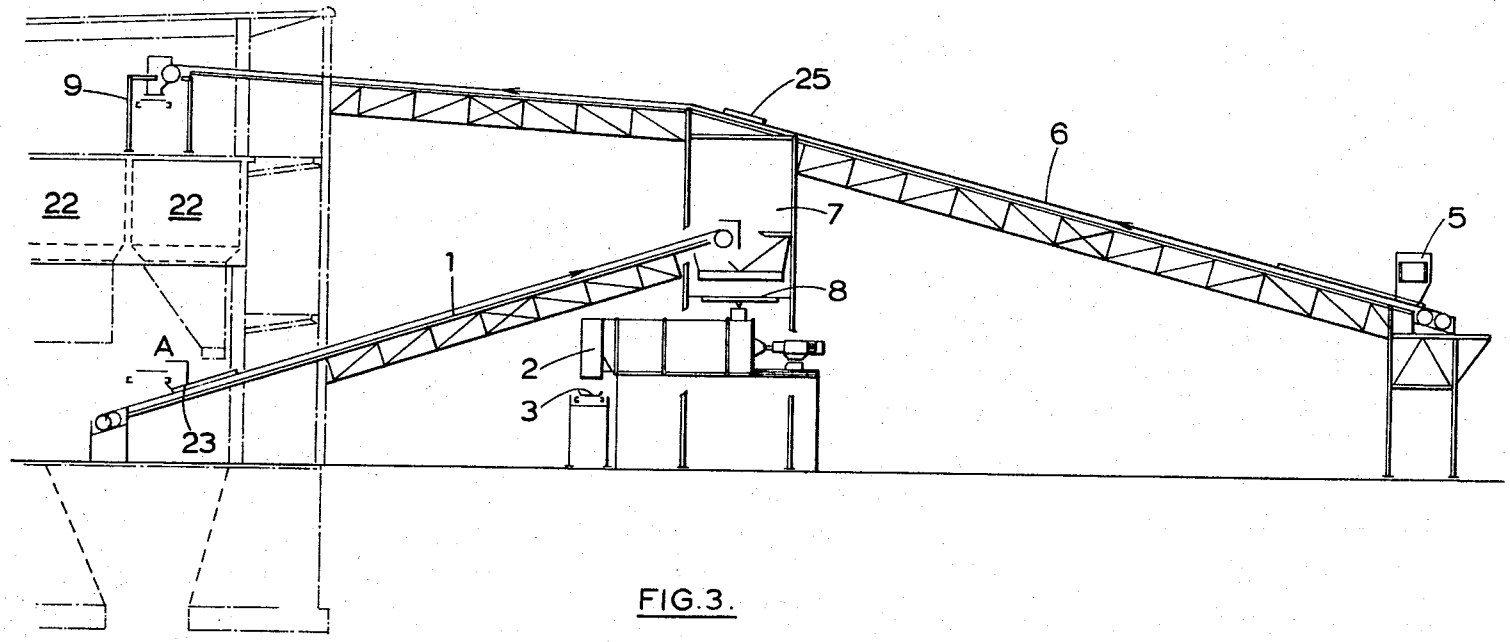
Figure 4:
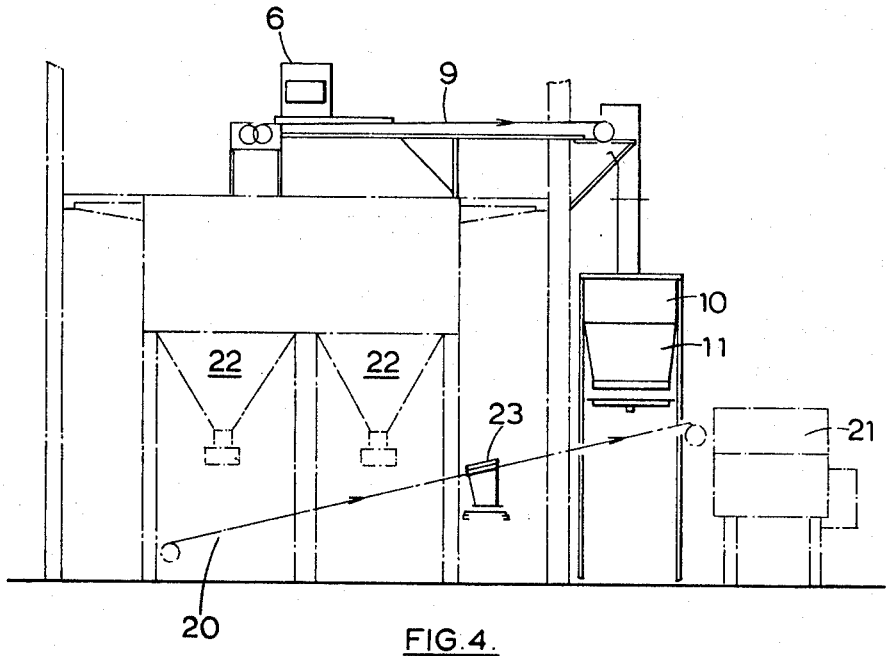
Figure 5:
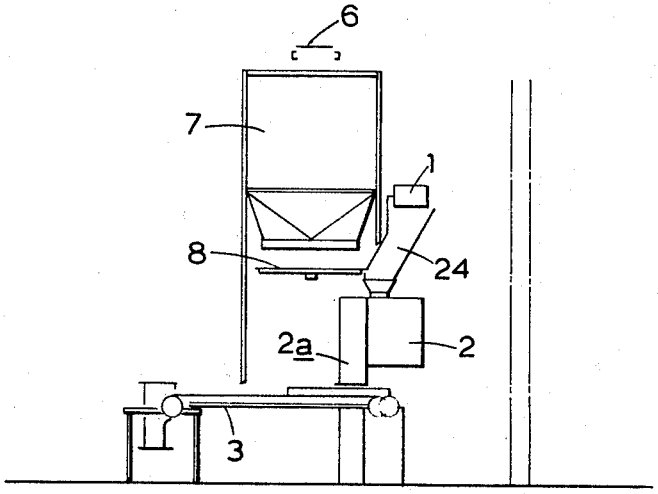

At position A on belt 20 there is a plough 23 which diverts the hot used sand onto a supply conveyor 1 that elevates the sand to a chute 24 (FIG. 5) feeding a mixer 2. The mixer has a discharge 2*a* opening to a cross conveyor 3 which discharges to an elevator 4 for carrying mixed sand up to an elevated cross conveyor 5. The discharge 2*a* is adjustable to vary the rate of supply of the mixed sand to the cross conveyor 3.

The cross conveyor 5 is inclined downwardly towards a further elevator 6 which ascends over a hopper 7. Over the mouth of the hopper 7 are a pair of diverter plates 25 which sweep a fraction of the sand on the elevator 6 into the hopper 7 from which the sand is discharged into the mixer 2 by a valve 8. The diverter plates are adjustable to control the ratio of the supply of the first and second fractions.

The remaining fraction is advanced further by the elevator 6 to a discharge conveyor 9 which discharges sand into a hopper 10 from which the sand can be discharged by a valve 11. The valve 11 is over the part of the conveyor 20 which is empty of hot used sand because that has been diverted by the plough 23. As aforementioned the conveyor 20 leads to the mill 21.

The conveyor means comprising the cross conveyors 3 and 5, elevators 4 and 6 is provided with mould boards (not shown) for turning over and mixing the sand carried thereon.

In the continuous operation of this apparatus the conveyor means always carries sand which is cooled whilst on the conveyor means. The hot used sand is mixed with a fraction of cool sand from the hopper 7 in the mixer 2 and water may be added as appropriate in the mixer. The sand mixture is then discharged onto the conveyor means for one circuit until a fraction is diverted into the hopper 7 with the remaining fraction that is carried on by the elevator 6, being discharged onto discharged conveyor 9 to the hopper 10 for the mill.

In the continuous operation of the apparatus illustrated, assuming a sand/casting rate of about 100 tons per hour, hot used sand is delivered to the mixer at a rate of about 100 tons per hour where it is mixed with cooler sand. The mixed sand is discharged to the conveyor means at a rate of about 200 tons per hour. The diverter plates are arranged to divert about 50% of the mixed sand i.e. about 100 tons per hour into the hopper 7 and the remaining 50% (about 100 tons per hour) passes to the discharge conveyor 9. Thus the rate of supply of hot used sand is substantially the same as the rate of discharge of cooled sand to the discharge conveyor and this rate is approximately equal to the sand/casting rate. If the rate of discharge of the mixed sand onto the conveyor means is altered, the position of the diverter plates must be altered accordingly to ensure the rate of discharge of cooled sand remains substantially the same as the rate of supply of hot used sand.

Similarly any change in the rate of supply of hot used sand can be accommodated by altering either the rate of discharge of the mixed sand or the position of the diverter plates or a combination of both in order to ensure the rate of supply of cooled sand to the discharge conveyor remains substantially the same as the rate of supply of the hot used sand.

As will be appreciated, in modifying an existing plant the carrying capacity of the conveyor 20 is solely related to the sand/casting rate and does not have to be increased to accommodate the supplementary facility of cooling and mixing hot used sand with cool sand. The conveyor means is the only part that has to be provided with extended facilitates for carrying extra sand, and all building and erection work can be carried out without substantial interference to existing plant. The provision of the plough 23 is a relatively simple modification to the conveyor 20 and the plough 23 may be arranged for quick removal.

In a modification, the speed of the conveyor means can be adjusted by any suitable means (not shown) known to those skilled in the art. Assuming a constant rate of discharge of the mixed sand onto the conveyor means, it will be apparent that an increase in the speed of the conveyor means, for example a fourfold increase, will result in a similar reduction in the depth of the sand carried by the conveyor means. As a result, the effective exposed surface area of the mixed sand is considerably increased and the rate of cooling of the mixed sand is increased. The rate of cooling achieved by an increase in speed of the conveyor means is an improvement on the rate of cooling achieved using the moulding boards and a slower speed of the conveyor means. The moulding boards may therefore be omitted altogether. In addition, the reduced depth of sand enables shallower conveyor means to be used and also reduces the sand loss.

The conveyor means may be arranged in any suitable configuration to suit an existing site, or a special purpose building. Overhead arrangements are easily arranged. The elevators of the conveyor means are preferably belt conveyors, and the cross conveyors are also belt conveyors so that cooling can occur whilst the sand is being conveyed. However, the type of conveyors, elevators, mixer and controls may be chosen as required.

I claim:

1. A process for cooling and handling sand comprising the steps of: mixing hot used sand with cool sand for cooling the hot used sand; circulating the mixed sand on conveyor means for cooling the mixed sand; and separating the mixed sand cooled on the conveyor means to provide a first cool sand fraction for discharce to successive milling and moulding stages, and a second cool sand fraction for said mixing with hot used sand.

2. A process according to claim 1, wherein water is added during mixing of the hot used sand with the cool sand for controlling the moisture content of the mixed sand.

3. A process according to claim 1 wherein the rate of circulation of the mixed sand is greater than the rate of supply of the hot used sand.

4. A process according to claim 3 wherein the rate of supply of hot used sand corresponds substantially to the rate of discharge of the first fraction.

5. A process according to claim 4 wherein the rate of circulation of the mixed sand and the rate of discharge of the first fraction are adjustable.

6. A process according to claim 1 wherein the hot used sand is supplied on supply conveyor means to mixing means for said mixing with the cool sand.

7. A process according to claim 1 wherein the mixed sand circulating on said conveyor means is turned over to increase the rate of cooling of the mixed sand.

8. A process according to claim 1 wherein the mixed sand is supplied to said conveyor means at a constant rate and the speed of said conveyor means is adjustable to control the effective exposed surface area of the mixed sand.

* * * * *